US007458458B2

(12) United States Patent
Marco

(10) Patent No.: US 7,458,458 B2
(45) **Date of Patent: *Dec. 2, 2008**

(54) SLEEVED CONTAINER PACKAGE WITH OPENING FEATURE

(75) Inventor: Leslie S. Marco, Bloomingdale, IL (US)

(73) Assignee: Illinois Tool Works Inc., Glenview, IL (US)

( * ) Notice: Subject to any disclaimer, the term of this patent is extended or adjusted under 35 U.S.C. 154(b) by 296 days.

This patent is subject to a terminal disclaimer.

(21) Appl. No.: 11/021,263

(22) Filed: Dec. 23, 2004

(65) Prior Publication Data

US 2005/0109640 A1 May 26, 2005

Related U.S. Application Data

(63) Continuation-in-part of application No. 10/396,610, filed on Mar. 25, 2003, now Pat. No. 6,896,129, which is a continuation-in-part of application No. 10/301,212, filed on Nov. 21, 2002, now Pat. No. 6,923,314, which is a continuation-in-part of application No. 10/251,312, filed on Sep. 20, 2002, now abandoned.

(51) Int. Cl.
*B65D 75/00* (2006.01)

(52) U.S. Cl. ..... 206/150; 206/147

(58) Field of Classification Search ..... 206/145, 206/147, 150, 151, 155, 161, 170, 174, 201, 206/427, 430, 434, 497; 229/240
See application file for complete search history.

(56) References Cited

U.S. PATENT DOCUMENTS

| | | | | |
|---|---|---|---|---|
| 2,339,156 A | * | 1/1944 | Davis | 229/117.33 |
| 2,359,297 A | | 10/1944 | Brogden | 229/16 |
| 3,084,792 A | | 4/1963 | Poupitch | 206/56 |
| 3,118,537 A | | 1/1964 | Copping | 206/65 |
| 3,186,544 A | | 6/1965 | Curry et al. | 206/65 |
| 3,302,783 A | | 2/1967 | Lyon | 206/65 |
| 3,326,364 A | * | 6/1967 | Waldrop et al. | 206/466 |
| 3,330,408 A | | 7/1967 | Wanderer | 206/65 |
| 3,385,429 A | | 5/1968 | Becker et al. | 206/65 |
| 3,447,675 A | | 6/1969 | Kirby | 206/65 |
| 3,504,790 A | | 4/1970 | Owen | 206/65 |
| 3,509,684 A | | 5/1970 | Hohl et al. | 53/48 |
| 3,515,272 A | | 6/1970 | Von Gal | 206/65 |
| 3,570,663 A | | 3/1971 | Cunningham | 206/65 |
| 3,687,282 A | | 8/1972 | Owen | |
| 3,700,275 A | | 10/1972 | Deasy | 294/87.2 |
| 3,721,337 A | | 3/1973 | Braun et al. | 206/65 |
| 3,734,280 A | | 5/1973 | Amneus et al. | 206/65 |
| 3,784,003 A | | 1/1974 | Bolton | 206/65 |
| 3,923,155 A | | 12/1975 | Tanzer | 206/427 |

(Continued)

FOREIGN PATENT DOCUMENTS

| | | |
|---|---|---|
| DE | 9103473 | 6/1991 |

(Continued)

*Primary Examiner*—J. Gregory Pickett

(57) ABSTRACT

A sleeve for a package of containers such as a group of beverage bottles and cans. The sleeve surrounds the group of containers held by a carrier. The sleeve includes a parting line allowing separation of the sleeve to release the containers, and a tear-initiating breach in the sleeve configured to yield to pressure and initiate tearing along the parting line.

13 Claims, 4 Drawing Sheets

U.S. PATENT DOCUMENTS

| | | | | | |
|---|---|---|---|---|---|
| 4,018,331 | A | | 4/1977 | Klygis | 206/199 |
| 4,066,166 | A | | 1/1978 | Klygis | 206/427 |
| 4,099,616 | A | | 7/1978 | Klygis | 206/427 |
| 4,121,401 | A | | 10/1978 | Duerr et al. | 53/398 |
| 4,218,086 | A | | 8/1980 | Klygis | 294/87.2 |
| 4,248,470 | A | | 2/1981 | Yuda et al. | 294/87.2 |
| 4,269,308 | A | | 5/1981 | Platt | 206/150 |
| 4,289,236 | A | | 9/1981 | Ganz et al. | 206/432 |
| 4,296,858 | A | | 10/1981 | Platt | 206/150 |
| 4,300,681 | A | | 11/1981 | Klygis et al. | 206/428 |
| 4,354,333 | A | | 10/1982 | McArdle | 53/48 |
| 4,385,690 | A | | 5/1983 | Olsen | 206/150 |
| 4,386,698 | A | | 6/1983 | Klygis | 206/432 |
| 4,460,084 | A | | 7/1984 | Miller | 206/158 |
| 4,471,870 | A | | 9/1984 | Uhlig | 206/150 |
| 4,520,924 | A | | 6/1985 | Edwards et al. | 206/150 |
| 4,523,676 | A | | 6/1985 | Barrash | 206/150 |
| 4,592,914 | A | * | 6/1986 | Kuchenbecker | 426/107 |
| D286,020 | S | | 10/1986 | Barrash | D9/369 |
| 4,628,666 | A | | 12/1986 | Lems | 53/398 |
| 4,726,473 | A | | 2/1988 | Sato et al. | 206/606 |
| 4,807,751 | A | | 2/1989 | Klygis et al. | 206/427 |
| 4,815,589 | A | | 3/1989 | Allen et al. | 206/150 |
| 4,828,110 | A | | 5/1989 | Lems | 206/427 |
| 4,893,712 | A | | 1/1990 | Allen | 206/150 |
| 4,919,265 | A | | 4/1990 | Lems et al. | 206/432 |
| 4,932,528 | A | | 6/1990 | Benno | 206/432 |
| 5,154,289 | A | | 10/1992 | Van Erden | 206/432 |
| 5,160,030 | A | | 11/1992 | Binsfeld | 206/497 |
| 5,425,446 | A | | 6/1995 | Weaver et al. | 206/145 |
| 5,437,370 | A | | 8/1995 | Marco | 206/430 |
| 5,452,794 | A | | 9/1995 | DiVietro | 206/150 |
| 5,467,870 | A | | 11/1995 | Broskow et al. | 206/162 |
| 5,487,463 | A | | 1/1996 | Harris | 206/145 |
| 5,505,304 | A | | 4/1996 | Broskow et al. | 206/427 |
| 5,642,808 | A | | 7/1997 | Marco et al. | 206/150 |
| 5,701,994 | A | | 12/1997 | Marsh | 206/203 |
| 5,749,171 | A | * | 5/1998 | Weder | 47/72 |
| 5,842,569 | A | * | 12/1998 | Weder | 206/423 |
| 5,938,014 | A | * | 8/1999 | Wilkinson | 206/216 |
| 6,145,656 | A | | 11/2000 | Marco | 206/147 |
| 6,213,293 | B1 | | 4/2001 | Marco | 206/147 |
| 6,415,917 | B1 | | 7/2002 | Marco | 206/147 |
| 6,896,129 | B2 | | 5/2005 | Marco | 206/150 |
| 6,913,189 | B2 | * | 7/2005 | Oliff et al. | 229/120.011 |

FOREIGN PATENT DOCUMENTS

| | | |
|---|---|---|
| EP | 0733561 | 9/1996 |
| EP | 0 782 962 A1 | 7/1997 |
| WO | WO 99/67138 | 12/1999 |

* cited by examiner

SLEEVED CONTAINER PACKAGE WITH OPENING FEATURE

CROSS-REFERENCE TO RELATED APPLICATIONS

The present application is a continuation-in-part of U.S. patent application Ser. No. 10/396,610 filed on Mar. 25, 2003 now U.S. Pat. No. 6,896,129, which is a continuation-in-part of U.S. patent application Ser. No. 10/301,212 filed on Nov. 21, 2002 now U.S Pat. No. 6,923,314, which is a continuation-in-part of U.S. patent application Ser. No. 10/251,312 filed on Sep. 20, 2002 now abandoned.

FIELD OF THE INVENTION

The present invention relates to packages for groups of containers, and, more particularly, to opening features for container packages including plastic carriers having arrays of loops for engaging and holding individual containers and sleeves surrounding the group of containers.

BACKGROUND OF THE INVENTION

Container carriers are used frequently to unitize a plurality of containers, such as bottles or cans, into conveniently saleable quantities. Both paperboard and plastic are materials commonly used. Paperboard carriers generally comprise a box in which the containers are held. The box may be totally enclosed, or may have an open top, with individual compartments for each container. Disadvantages of paperboard carriers include excess material and cost. Further, once opened, an enclosed box no longer holds the containers securely. An open top carrier can spill the contents therein, if inverted.

Plastic carriers have achieved wide acceptance for their performance, low weight, low cost and versatility in being adapted for containers of different sizes and shapes. The general design for plastic carriers includes apertures in a stretchable plastic material. The apertures are sized and shaped to stretch around the periphery of the containers to be held, either bottles or cans. For convenient carrying of a group of containers held by the carrier, various types of hand-grasps are known. Automated machinery is available for attaching stretchable plastic carriers to containers quickly and efficiently.

In one such known design, the carrier is formed from two webs of plastic material juxtaposed over one another. Handle portions and container engaging portions are stamped from the juxtaposed webs simultaneously. The webs are fused or welded along selected portions. The resulting handle portion is thereby a double thickness of material, and the container engaging portions freely depend from the remainder of the carrier, at each side thereof. The container engaging portions are a single ply of material.

A trend in the beverage industry is to group larger quantities of containers, and/or containers of larger size. A large group of containers, whether bottles or cans, secured only by stretchable rings in an array of a plastic carrier, might have a feel of instability, with individual containers allowed to skew or twist relative to other containers in the group. Even with smaller quantities of containers, such as six-packs, the feeling of insecurity can occur as the containers twist and skew while being carried.

In co-pending, commonly owned U.S. patent application Ser. No. 10/251,312, a plastic carrier is provided with an array of rings, including one ring for each container, and a stretchable sleeve surrounds the group of containers. In co-pending commonly owned U.S. patent application Ser. No. 10/396,610 the stretchable sleeve is provided with an aperture through which a tab of the carrier is accessed to tear the sleeve and carrier simultaneously when releasing containers.

What is needed in the art is a well-secured container package that has an easy and convenient opening feature.

SUMMARY OF THE INVENTION

The present invention provides a stretchable sleeve for surrounding and securing a group of containers. The sleeve has at least one parting line that opens to release the packaged containers from the sleeve. A starting point for tearing the sleeve yields to pressure to commence tearing along the parting line.

In one form thereof, the invention provides a package for a group of containers with a plastic carrier including a container holding portion of interconnected stretchable loops and a sleeve surrounding the group of containers, the sleeve having first and second edges. At least one parting line in the sleeve is adapted for separation and has an end positioned to open an edge of the sleeve. A tear-initiating breach in the sleeve is associated with an opposite end of the parting line for yielding to pressure applied against the sleeve in the vicinity thereof to initiate tearing along the parting line.

In another form thereof, the invention provides a package of containers with a carrier including a plurality of loops, a group of containers with each container disposed and secured in a loop, and a stretchable sleeve surrounding the group of containers. The sleeve has first and second edges and at least one parting line adapted for separation to release the containers from the sleeve. The parting line has an end near at least one of the edges for causing a separation of the sleeve through the edge. A tear-initiating breach in the sleeve is associated with an opposite end of the parting line for yielding to pressure applied against the sleeve in the vicinity thereof and initiating tearing along the parting line.

In a further form thereof, the invention provides a sleeve for a group of containers held in a package. The sleeve has a band of stretchable material, and at least one parting line in the band having an end near at least one of the edges of the band for causing separation of the band through the edge. A tear-initiating breach in the band is associated with the parting line for yielding to pressure applied against the band in the vicinity thereof and initiating tearing along the parting line.

An advantage of the present invention is providing a package that retains individual containers in a secure manner yet is easily and conveniently opened to release containers.

Another advantage of the present invention is providing a container package with a visual cue to the operation of individual release functions for the containers.

Still another advantage of the present invention is providing a sleeved container package in which a sleeve surrounding the containers can be removed without releasing individual containers from a carrier.

A further advantage of the present invention is providing a container package including a carrier and a sleeve useful for grouping containers of various types.

Other features and advantages of the invention will become apparent to those skilled in the art, upon review of the following detailed description, claims and drawings, in which like numerals are used to designate like features.

Figure 1:
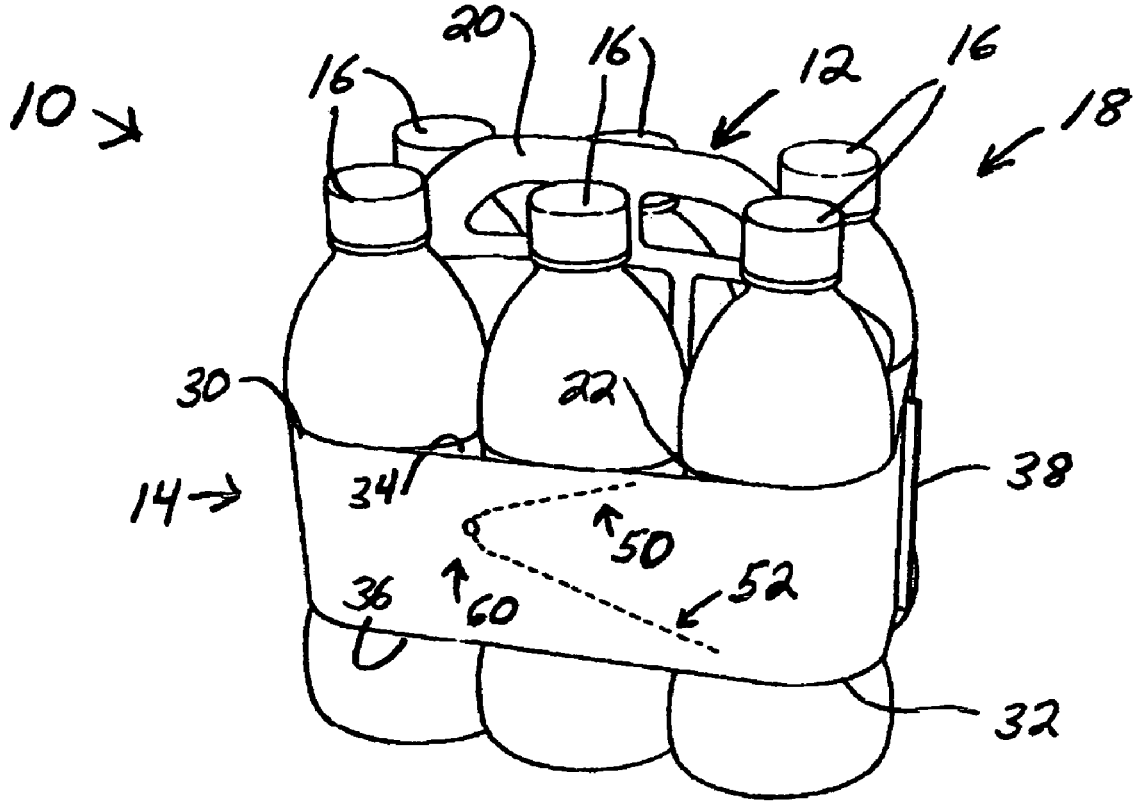
FIG. 1 is a perspective view of containers in a package in accordance with the present invention.

Before the embodiments of the invention are explained in detail, it is to be understood that the invention is not limited in its application to the details of construction and the arrangements of the components set forth in the following description, or illustrated in the drawings. The invention is capable of other embodiments and of being practiced or being carried out in various ways. Also, it is understood that the phraseology and terminology used herein are for the purpose of description, and should not be regarded as limiting. The use herein of "including" and "comprising", and variations thereof is meant to encompass the items listed thereafter, and equivalents thereof, as well as additional items and equivalents thereof.

DETAILED DESCRIPTION OF THE PREFERRED EMBODIMENT

Referring now more specifically to the drawings, and to FIG. 1 in particular, a container package 10 in accordance with the present invention is shown. Package 10 includes a carrier 12 and a sleeve 14. In the exemplary embodiment shown in the drawings, package 10 is provided for a so-called six-pack, and is shown for packaging a plurality of individual containers 16 into a group 18 of containers 16. However, it should be understood that the present invention can be used advantageously for packaging more or fewer containers 16 than the six-pack shown. Further, while package 10 is illustrated for packaging individual containers 16 in the form of bottles, package 10 can be used for packaging containers 16 other than bottles. For example, package 10 can be used also for packaging cans, and for bottles of different shapes.

Carrier 12 includes a handle and suspension portion 20 and a plurality of container holding loops 22. The configuration of carrier 12 will vary depending on the size, type and quantity of containers 16 to be held in carrier 12. In a preferred design for carrier 12 to hold a six pack as illustrated, carrier 12 is a two-ply structure having first and second sheets juxtaposed on each other, and connected by one or more welds. However, sleeve 14 can be used with different types of carriers, including single-ply carriers. The manner in which such carriers are made is well known to these skilled in the art and will not be described in greater detail herein.

Referring now particularly to FIG. 1, sleeve 14 is formed as an endless band surrounding the perimeter of group 18 of containers 16 held by carrier 12. Sleeve 14 has a top edge 30 and a bottom edge 32, with an open top 34 and an open bottom 36. Containers 16 extend above top edge 30 and below bottom edge 32, through open top 34 and open bottom 36, respectively. Advantageously, sleeve 14 has a substantial height between top edge 30 and bottom edge 32, to provide a large billboard area to display information, and to provide greater stability to package 10. Sleeve 14 can be formed from a strip of stretchable material formed into an endless band by bonding ends of the strip at a seam 38.

In a contemplated procedure for using package 10, sleeve 14 is applied after carrier 12 has been attached to individual containers 16. Sleeve 14 is stretched to surround group 18 of containers 16, and is positioned there around to cover loops 22 of carrier 12. The application of carrier 12 to individual containers 16 to form group 18, and the placement of sleeve 14 around group 18 can be performed with automated equipment known to those skilled in the art.

Alternatively, sleeve 14 can be of shrink fit material placed around group 18, and subsequently heated or otherwise activated to constrict against containers 16. Sleeve 14 also can be material pulled taut around group 18 and adhered or otherwise bonded or fastened together.

Sleeve 14 stabilizes group 18, minimizing the degree to which individual containers 16 can twist or skew relative to other containers 16 within group 18. The cooperative association of carrier 12 and sleeve 14 provides a firm, stable feel to package 10, increasing the comfort and confidence of consumers carrying the package.

Figure 2:
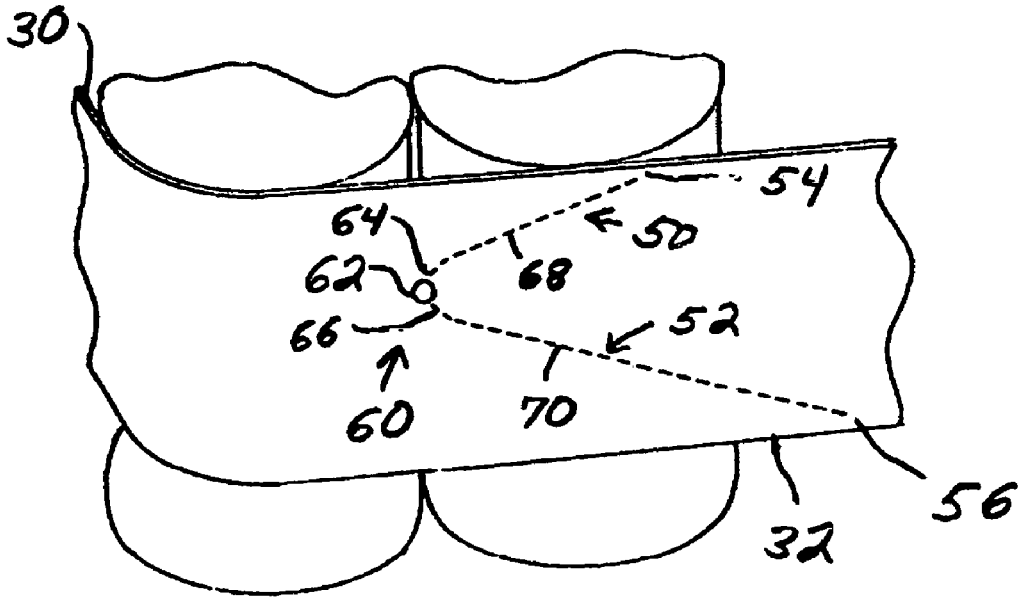
FIG. 2 is an enlarged, fragmentary perspective view of the container package shown in FIG. 1.

To facilitate removal of the sleeve, separation can occur along a parting line toward an edge or edges of the sleeve. FIGS. 1 and 2 illustrate an embodiment of the invention in which two parting lines 50, 52 in the nature of spaced perforations or holes extend from a point intermediate edges 30 and 32 to near top edge 30 and near bottom edge 32, respectively.

It is preferred that the outer ends of parting lines 50 and 52 terminate some minimal distance from edges 30 and 32 to provide a non-perforated segment 54, 56, respectively, between the end of the parting line and edge 30, 32, respectively. As parting lines 50, 52 are separated, segments 54, 56 are easily breached so that separation occurs through edges 30, 32, facilitating release of sleeve 14. Perforations forming parting lines 50, 52 can be of various shapes, including substantially circular holes or punctures, or elongated holes or slits. If elongated perforations are used for parting lines 50, 52, the orientation of the elongated perforations should not be perpendicular to the primary direction of tension in sleeve 14. Thus, if elongated slits are used for parting lines 50, 52 it is preferred that parting lines 50, 52 are not perpendicular to top edge 30 and/or bottom edge 32. Instead, parting lines 50, 52 should extend at some significant, non-perpendicular angle to edges 30, 32 to minimize inadvertent and unintended parting of sleeve 14 along parting lines 50, 52 from the tension in sleeve 14. With parting lines 50, 52 consisting of a series of elongated slits each about 0.020 inch long, separated by uncut segments about 0.030 inch long, an angle of between about 15 degrees and about 20 degrees has worked effectively.

Parting lines 50, 52 originate at a location intermediate edges 30, 32 at a tear initiating breach 60 within sleeve 14. Tear initiating breach 60 can be in a variety of configurations including a small hole or aperture 62 as illustrated in FIGS. 1 and 2. Tear initiating breach 60 is configured in such a manner and arranged in sleeve 14 with respect to containers 16 held thereby, so that breach 60 yields to pressure exerted in the vicinity thereof against sleeve 14 to induce tearing along parting lines 50, 52. In the embodiment illustrated, aperture 62 is arranged substantially intermediate two adjacent bottles 16 and loops 22 holding bottles 16. In this position, pressure applied against sleeve 14 in the area of aperture 62 causes the sleeve to deflect and tearing to commence along parting lines 50, 52. Pressure can be exerted by a finger or implement substantially normal to sleeve 14 or at an angle with respect thereto. As illustrated, aperture 62 is nearer top edge 30 than bottom edge 32. However, in some configurations it may be desirable to place tear-initiating breach 60 nearer to bottom edge 32 than to top edge 30 or substantially intermediate top edge 30 and bottom edge 32.

If provided as a hole or aperture 62, tear-initiating breach 60 can be small. A hole having a diameter of 0.250 inch has been found to be adequate for inducing tearing along parting lines 50, 52.

Figure 3:
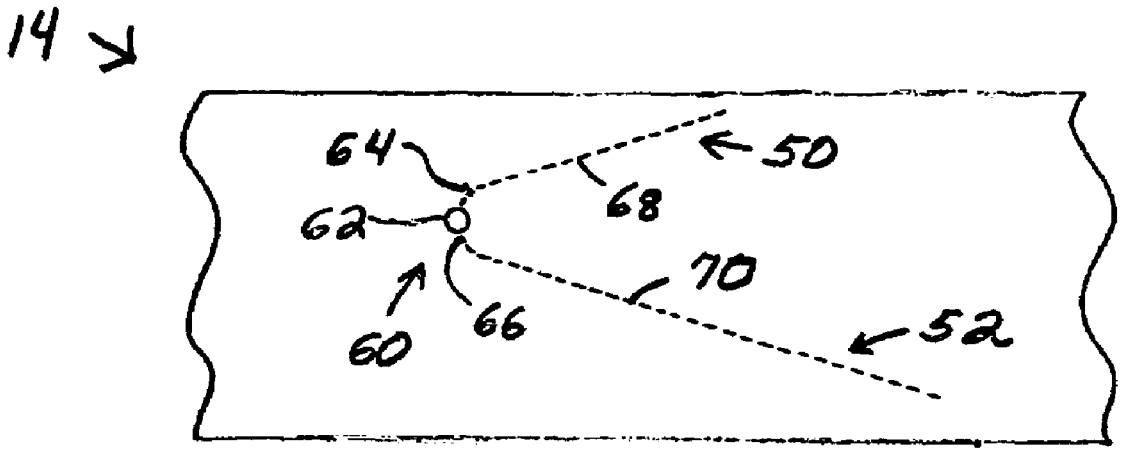
FIG. 3 is a fragmentary, elevational view of the sleeve shown in FIG. 1.

Parting lines 50, 52 can take a variety of configurations to facilitate intended tearing while reducing the tendency for unintended tearing therealong. As illustrated in FIGS. 1 and 2 and more pronounced in FIG. 3, inner portions 64, 66 of parting lines adjacent aperture 62 are curved toward aperture 62 and remaining portions 68 and 70, respectively, thereof are substantially straight.

Figure 4:
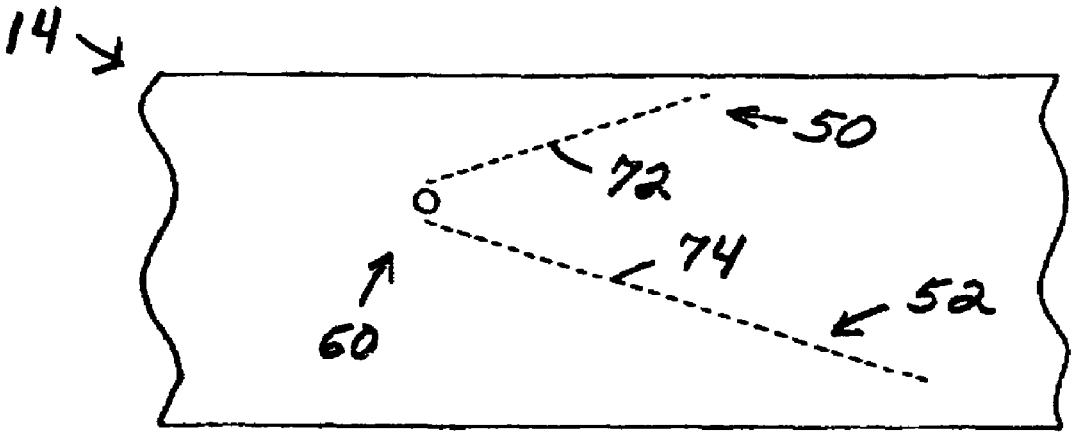
FIG. 4 is a fragmentary, elevational view of a second embodiment for a sleeve of the present invention.

In other configurations, parting lines 50, 52 can be substantially straight throughout their entire length. FIG. 4 illustrates an arrangement with tear initiating breach 60 as a hole 62 and parting lines 50, 52 as straight lines of perforations 72, 74, respectively.

Figure 5:
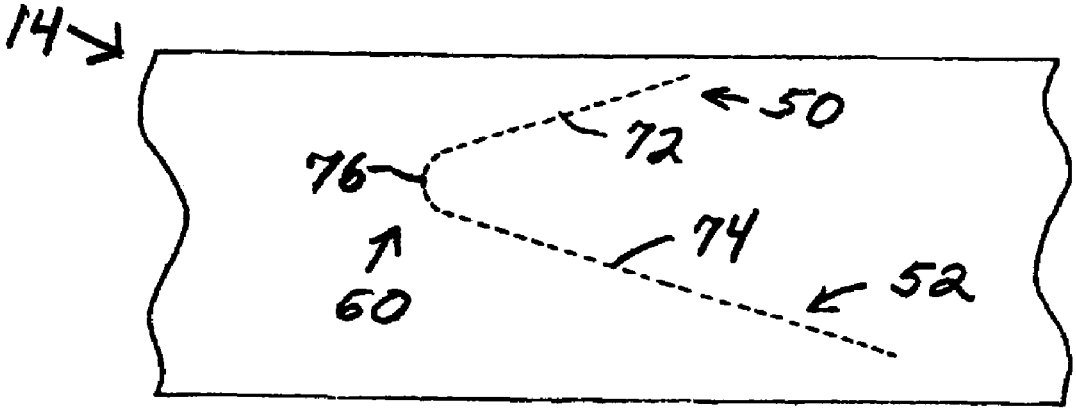
FIG. 5 is a fragmentary, elevational view of another embodiment for the sleeve.
Figure 7:
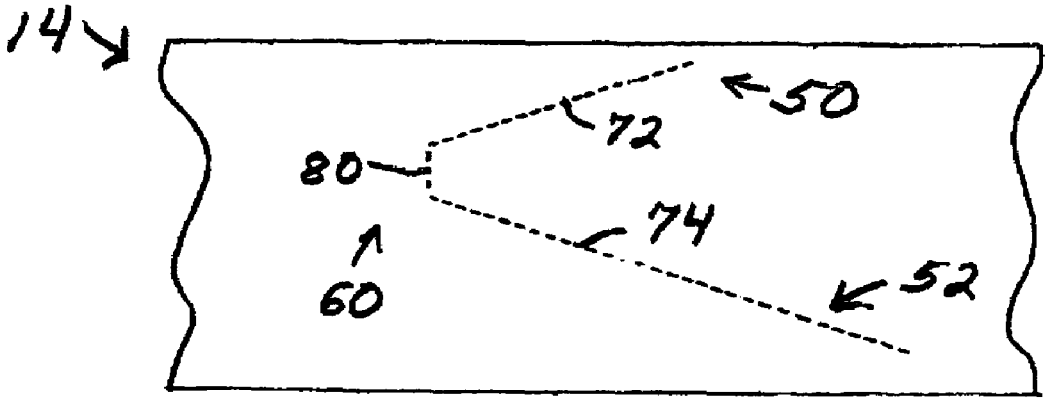
FIG. 7 is a fragmentary, elevational view of a still further modified sleeve.
Figure 8:
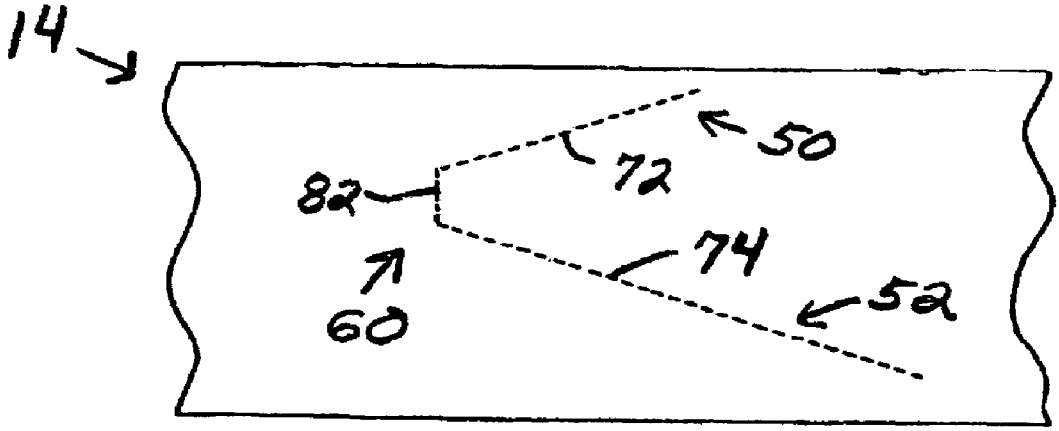
FIG. 8 is a fragmentary, elevational view of yet another modified sleeve.

Tear initiating breach 60 can be of configurations other than a hole or aperture 62. In FIG. 5, tear initiating breach 60 is a curved line of perforations 76 substantially interconnecting straight parting lines 72, 74. FIGS. 7 and 8 illustrate embodiments in which tear initiating breach 60 comprises a substantially straight line of perforations 80, 82, respectively, which can be more closely spaced (FIG. 7) or more distantly spaced (FIG. 8), from straight parting lines 72, 74.

Figure 6:
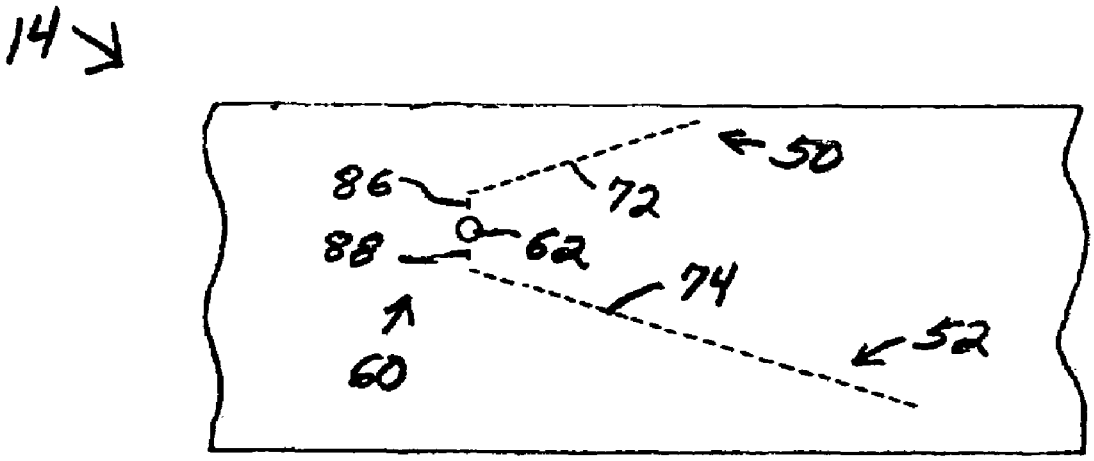
FIG. 6 is a fragmentary, elevational view of a further modified sleeve of the present invention.

FIG. 6 illustrates an embodiment in which tear initiating breach 60 comprises a combination of an aperture 62 and short lines of perforations 86, 88 extending therefrom to straight parting lines 72, 74.

Figure 9:
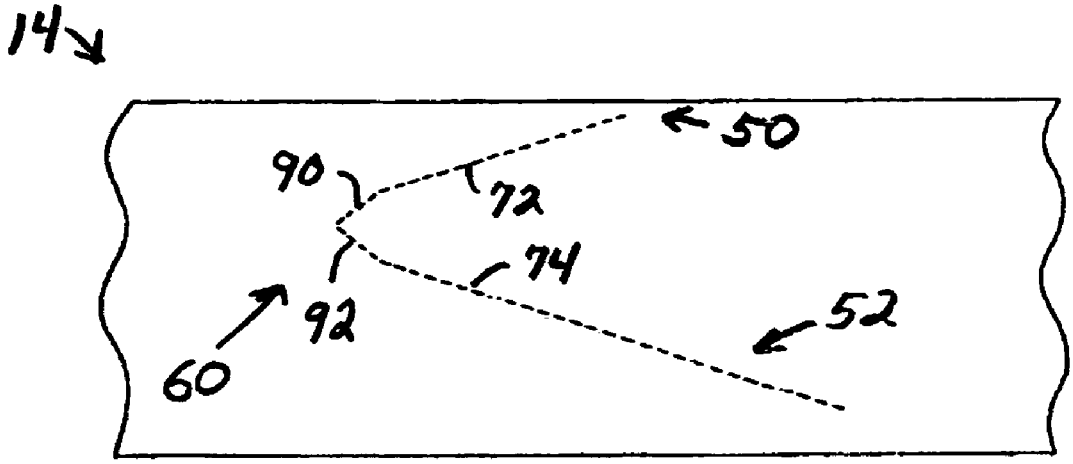
FIG. 9 is a fragmentary, elevational view of still another modified sleeve.

FIG. 9 illustrates an embodiment in which tear initiating breach 60 comprises straight lines of perforations 90, 92 formed as legs of a "V" leading to straight parting lines 72, 74.

Figure 10:
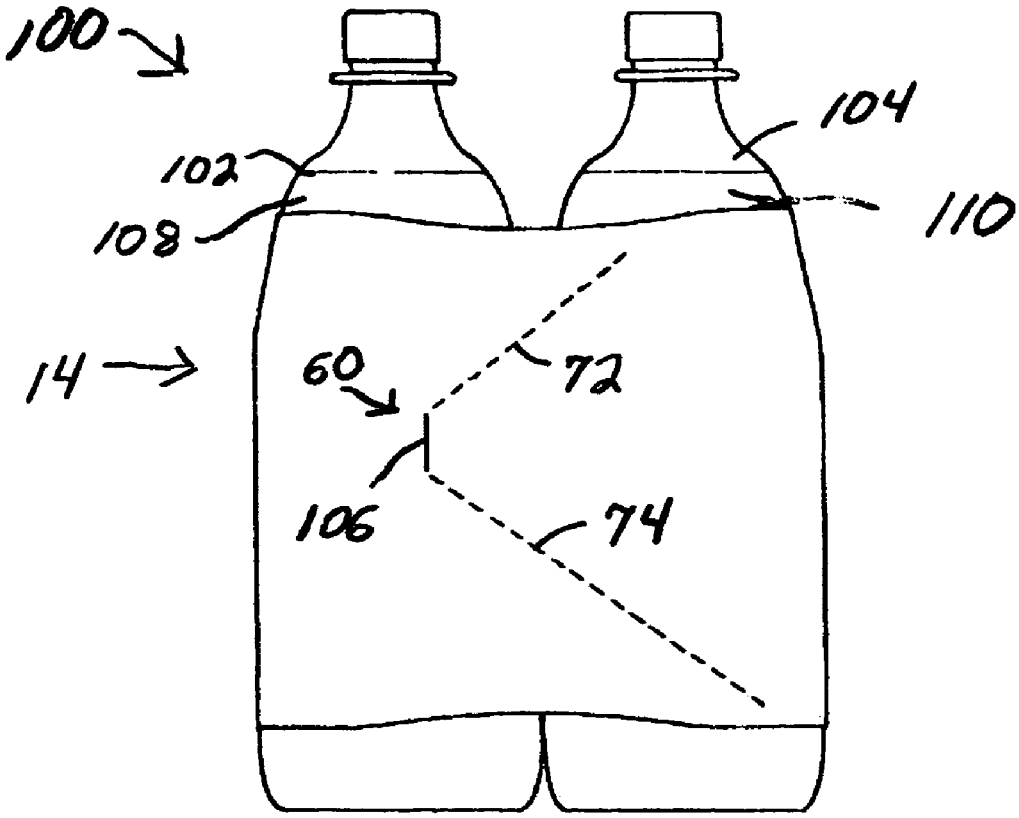
FIG. 10 is an elevational view of the present invention, illustrating use with large two-bottle packages.

FIG. 10 illustrates an embodiment of the invention used for a package 100 of bottles 102, 104 without an additional carrier 12. Sleeve 14 surrounds bottles 102, 104 including narrowed portions 108, 110 thereof to hold bottles 102, 104 as a group. As shown in FIG. 10, sleeve 14 can form a group of containers even without a carrier 12. Alternatively yet further, various clips around necks of bottles, small amounts of adhesive between containers of various types, etc. also can be used instead of carrier 12.

As shown in FIG. 10, tear-initiating breach 60 comprises a slit 106, rather than an aperture or series of perforations. Although shown as being substantially straight, slit 106 also can be curved. Parting lines 72, 74 extend outwardly from slit 106. Slit 106 is illustrated not at a midpoint between bottles 102, 104 but instead closer to the center of bottle 102. As described previously herein, location at a midpoint between bottles 102, 104 facilitates initiating the tearing action. However, when a tear-initiating breach 60 in the nature of slit 106 is used, a finger tip or instrument can be used to enter slit 106 and commence tearing, even if only minimal or no open space is provided between sleeve 14 and bottle 102 immediately behind slit 106.

While tear-initiating breaches with associated parting lines have been shown on one side of sleeve 14, it should be understood that a tear-initiating breach and associated parting line or lines can be provided on both sides of sleeve 14. In still other configurations of the present invention, a tear-initiating breach and parting line or lines can be provided on one or both ends of sleeve 14

The present invention provides improved stability with a sleeve encircling containers held in a package or group. The sleeve is secure, yet easily opened when needed.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention, and will enable others skilled in the art to utilize the invention. The claims are to be construed to include alternative embodiments to the extent permitted by the prior art.

Various features of the invention are set forth in the following claims.

What is claimed is:

1. A package for a group of containers including individual containers to be held in rows, said package comprising;

a plastic carrier including a container holding portion of interconnected stretchable loops, one said loop for each said container, each said loop surrounding a different one of said containers;

a sleeve surrounding the group of containers, said sleeve having a top edge and a bottom edge defining an open top and an open bottom of said sleeve;

at least one parting line in said sleeve adapted for separation therealong and extending from a point intermediate said top and bottom edges toward at least one of said top and bottom edges, and having an end positioned to open said at least one of said top and bottom edges; and a tear-initiating breach in said sleeve spaced from said top edge and from said bottom edge and associated with said at least one parting line for yielding to pressure applied against said sleeve in the vicinity thereof to initiate tearing along said at least one parting line from said point intermediate said top and bottom edges and continuing toward said end positioned to open said at least one of said top and bottom edges.

2. A package for a group of containers including individual containers to be held in rows, said package comprising;

a plastic carrier including a container holding portion of interconnected stretchable loops, one said loop for each said container, each said loop surrounding a different one of said containers;

a sleeve surrounding the group of containers, said sleeve having first and second edges;

at least one parting line in said sleeve adapted for separation therealong and having an end positioned to open an edge of said sleeve; and a tear-initiating breach in said sleeve spaced from said first and second edges and associated with an opposite end of said at least one parting line for yielding to pressure applied against said sleeve in the vicinity thereof to initiate tearing along said at least one parting line from said tear-initiating breach toward said end positioned to open an edge of said sleeve, said tear-initiating breach disposed substantially between two of said loops.

3. A package for a group of containers including individual containers to be held in rows, said package comprising;

a plastic carrier including a container holding portion of interconnected stretchable loops, one said loop for each said container, each said loop surrounding a different one of said containers;

a sleeve surrounding the group of containers, said sleeve having first and second edges;

at least one parting line in said sleeve adapted for separation therealong and having an end positioned to open an edge of said sleeve; and a tear-initiating breach in said sleeve spaced from said first and second edges and associated with an opposite end of said at least one parting line for yielding to pressure applied against said sleeve in the vicinity thereof to initiate tearing along said at least one parting line from said opposite end toward said end positioned to open an edge of said sleeve, said tear-initiating breach being a line of perforations in said sleeve.

4. A package for a group of containers including individual containers to be held in rows, said package comprising;

a plastic carrier including a container holding portion of interconnected stretchable loops, one said loop for each said container, each said loop surrounding a different one of said containers;

a sleeve surrounding the group of containers, said sleeve having first and second edges;

at least one parting line in said sleeve adapted for separation therealong and having an end positioned to open an edge of said sleeve; and a tear-initiating breach in said sleeve and associated with an opposite end of said at least one parting line for yielding to pressure applied against said sleeve in the vicinity thereof to initiate tearing along said at least one parting line, said tear-initiating breach being perforations in said sleeve arranged in a "V" configuration.

5. A package for a group of containers including individual containers to be held in rows, said package comprising;

a plastic carrier including a container holding portion of interconnected stretchable loops, one said loop for each said container, each said loop surrounding a different one of said containers;

a sleeve surrounding the group of containers, said sleeve having a top edge and a bottom edge defining an open top and an open bottom of said sleeve;

at least one parting line in said sleeve adapted for separation therealong and extending from a point intermediate said top and bottom edges toward at least one of said top and bottom edges, and having an end positioned to open said at least one of said top and bottom edges; and a tear-initiating breach in said sleeve and associated with an opposite end of said at least one parting line for yielding to pressure applied against said sleeve in the vicinity thereof to initiate tearing along said at least one parting line;

said at least one parting line comprising two parting lines each extending from said tear-initiating breach to different said edges.

6. A package for a group of containers including individual containers to be held in rows, said package comprising;

a plastic carrier including a container holding portion of interconnected stretchable loops, one said loop for each said container, each said loop surrounding a different one of said containers;

a sleeve surrounding the group of containers, said sleeve having first and second edges;

at least one parting line in said sleeve adapted for separation therealong and having an end positioned to open an edge of said sleeve;

a tear-initiating breach in said sleeve spaced from and intermediate said first and second edges and associated with an opposite end of said at least one parting line for yielding to pressure applied against said sleeve in the vicinity thereof to initiate tearing along said at least one parting line from said opposite end toward said end positioned to open an edge of said sleeve; and said at least one parting line having a curved portion adjacent said tear-initiating breach.

7. The package of claim 1, said tear-initiating breach being a hole.

8. A package for a group of containers including individual containers to be held in rows, said package comprising;

a plastic carrier including a container holding portion of interconnected stretchable loops, one said loop for each said container, each said loop surrounding a different one of said containers;

a sleeve surrounding the group of containers, said sleeve having first and second edges;

at least one parting line in said sleeve adapted for separation therealong and having an end positioned to open an edge of said sleeve; and a tear-initiating breach in said sleeve intermediate said first and second edges and associated with an opposite end of said at least one parting line for yielding to pressure applied against said sleeve in the vicinity thereof to initiate tearing along said at least one parting line from said opposite end toward said end, said tear-initiating breach including a hole and a line of perforations.

9. A package of containers comprising;

a carrier including a plurality of loops;

a group of containers, one said container disposed and secured in each said loop;

a stretchable sleeve surrounding said group of containers, said sleeve having first and second edges and at least one parting line adapted for separation to release said containers from said sleeve, said at least one parting line having an end near at least one said edge for causing a separation of said sleeve through said at least one edge; and a tear-initiating breach in said sleeve spaced from said first and second edges and associated with an opposite end of said parting line for yielding to pressure applied against said sleeve in the vicinity thereof and initiating tearing along said parting line from said opposite end toward said end near at least one said edge, said tear-initiating breach disposed substantially intermediate two said containers.

10. A package of containers comprising;

a carrier including a plurality of loops;

a group of containers, one said container disposed and secured in each said loop;

a stretchable sleeve surrounding said group of containers, said sleeve having first and second edges and two parting lines adapted for separation to release said containers from said sleeve, said parting lines having ends near said edges for causing a separation of said sleeve through said edges; and a tear-initiating breach in said sleeve and associated with an opposite end of said parting line for yielding to pressure applied against said sleeve in the vicinity thereof and initiating tearing along said parting line, said tear-initiating breach being a line perforations in said sleeve arranged between said two parting lines, said tear-initiating breach being nearer one said edge than the other said edge, and said two parting lines extending from said tear-initiating breach toward different ones of said edges.

11. A package of containers comprising;

a carrier including a plurality of loops;

a group of containers, one said container disposed and secured in each said loop;

a stretchable sleeve surrounding said group of containers, said sleeve having first and second edges and at least one parting line adapted for separation to release said containers from said sleeve, said at least one parting line having an end near at least one said edge for causing a separation of said sleeve through said at least one edge; and a tear-initiating breach in said sleeve and associated with an opposite end of said parting line for yielding to pressure applied against said sleeve in the vicinity thereof and initiating tearing along said parting line, said tear-initiating breach being perforations in said sleeve arranged in a "V".

12. A package of containers, comprising;

a carrier including a plurality of loops;

a group of containers, one said container disposed and secured in each said loop;

a stretchable sleeve surrounding said group of containers, said sleeve having first and second edges and at least one parting line adapted for separation to release said containers from said sleeve, said at least one parting line having an end near at least one said edge for causing a separation of said sleeve through said at least one edge; and a tear-initiating breach in said sleeve spaced from said first and second edges and associated with an opposite end of said parting line for yielding to pressure applied against said sleeve in the vicinity thereof and initiating tearing along said parting line from said tear-initiating breach toward said at least one said edge, said tear-initiating breach including a hole and a line of perforations.

13. A package of containers, comprising;

a carrier including a plurality of loops;

a group of containers, one said container disposed and secured in each said loop;

a stretchable sleeve surrounding said group of containers, said sleeve having first and second edges and at least one parting line adapted for separation to release said containers from said sleeve, said at least one parting line having an end near at least one said edge for causing a separation of said sleeve through said at least one edge; and a tear-initiating breach in said sleeve spaced from said first and second edges and associated with an opposite end of said parting line for yielding to pressure applied against said sleeve in the vicinity thereof and initiating tearing along said parting line from said tear initiating breach toward said at least one said edge, said parting line including a curved segment of perforations.

* * * * *